US010363460B2

(12) United States Patent
Watanabe et al.

(10) Patent No.: US 10,363,460 B2
(45) Date of Patent: Jul. 30, 2019

(54) MULTI-PIECE SOLID GOLF BALL

(71) Applicant: Bridgestone Sports Co., Ltd., Tokyo (JP)

(72) Inventors: Hideo Watanabe, Chichibushi (JP); Tsuyoshi Nakajima, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/799,382

(22) Filed: Oct. 31, 2017

(65) Prior Publication Data

US 2018/0147453 A1 May 31, 2018

(30) Foreign Application Priority Data

Nov. 29, 2016 (JP) ..... 2016-231550

(51) Int. Cl.
*A63B 37/06* (2006.01)
*A63B 37/00* (2006.01)

(52) U.S. Cl.
CPC ..... *A63B 37/0075* (2013.01); *A63B 37/0031* (2013.01); *A63B 37/0033* (2013.01); *A63B 37/0043* (2013.01); *A63B 37/0045* (2013.01); *A63B 37/0048* (2013.01); *A63B 37/0051* (2013.01); *A63B 37/0065* (2013.01); *A63B 37/0076* (2013.01); *A63B 37/0077* (2013.01)

(58) Field of Classification Search
CPC ..... A63B 37/0048; A63B 37/0065
USPC ..... 473/373, 374
See application file for complete search history.

(56) References Cited

U.S. PATENT DOCUMENTS

| | | | | |
|---|---|---|---|---|
| 5,782,707 | A | 7/1998 | Yamagishi et al. | |
| 6,592,470 | B2 | 7/2003 | Watanabe et al. | |
| 6,814,676 | B2 | 11/2004 | Watanabe et al. | |
| 2009/0264220 | A1* | 10/2009 | Shindo | A63B 37/0003 473/376 |
| 2011/0098132 | A1* | 4/2011 | Higuchi | A63B 37/0003 473/373 |

FOREIGN PATENT DOCUMENTS

| | | | |
|---|---|---|---|
| JP | 2003-190330 | A | 7/2003 |
| JP | 3661812 | B2 | 6/2005 |
| JP | 3861983 | B2 | 12/2006 |

* cited by examiner

*Primary Examiner* — Raeann Gorden
(74) *Attorney, Agent, or Firm* — Sughrue Mion, PLLC

(57) ABSTRACT

In a multi-piece solid golf ball which includes a core of at least one layer, a cover of at least one layer, and at least one intermediate layer interposed between the core and the cover, the cover is composed primarily of polyurethane and the following parameters are controlled within specific ranges: core deflection, melt flow rate of intermediate layer material, thickness of intermediate layer, thickness and Shore D hardness of cover, combined thickness of intermediate layer and cover, and the value of (Shore D hardness of cover material)−(Shore D hardness of intermediate layer material). This golf ball has a good, soft feel at impact and lowers the rate of spin on full shots, achieving a good distance.

9 Claims, 1 Drawing Sheet

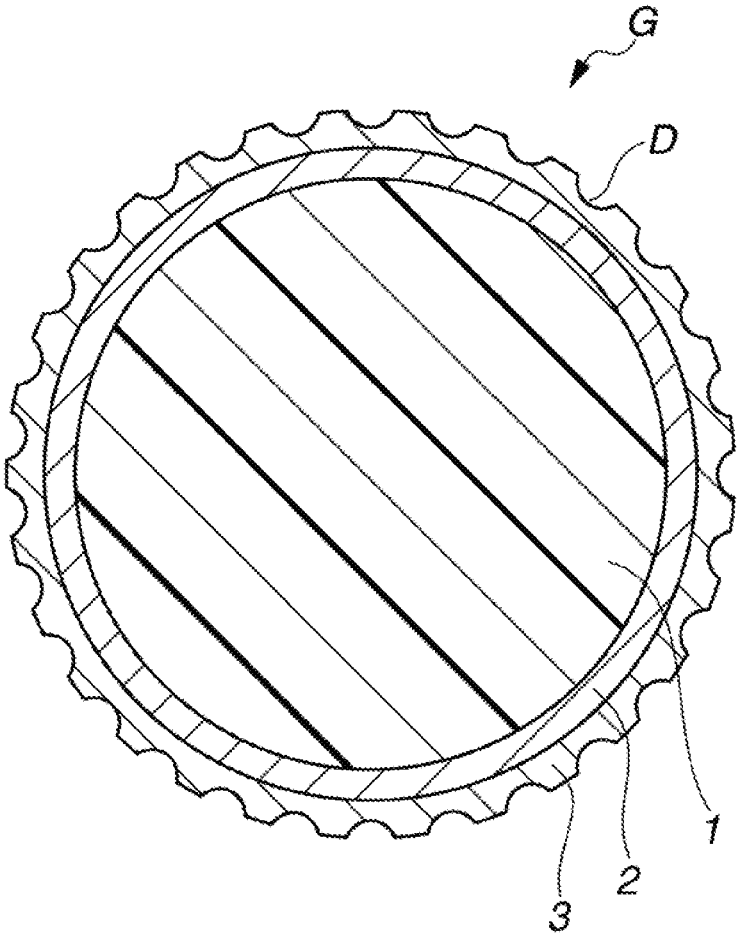
G
D
1
2
3

MULTI-PIECE SOLID GOLF BALL

CROSS-REFERENCE TO RELATED APPLICATION

This non-provisional application claims priority under 35 U.S.C. § 119(a) on Patent Application No. 2016-231550 filed in Japan on Nov. 29, 2016, the entire contents of which are hereby incorporated by reference.

TECHNICAL FIELD

This invention relates to a multi-piece solid golf ball having at least a three-layer construction that includes a core, an intermediate layer and a cover.

BACKGROUND ART

Numerous golf balls having two or more cover layers formed over the core, with the outermost layer made of a polyurethane-based elastomer or other resin material composed primarily of polyurethane, are available today on the market as golf balls for professional golfers and skilled amateurs. Moreover, much art has been described that attempts to, for example, increase the distance traveled by multi-piece solid golf balls having three or more pieces by optimizing the design (hardnesses, thicknesses, etc.) of the ball structure and forming the outermost layer of a urethane material.

For example, JP No. 3861983 describes a multi-piece solid golf ball of three or more pieces wherein the resin material in the outermost layer is formed of polyurethane, and parameters such as the thickness of the intermediate layer are controlled. JP-A 2003-190330 is a golf ball with an inner/outer two-layer cover in which a polyurethane elastomer is used as the primary material in the outer cover layer and the Shore D hardnesses of the core surface and the inner and outer cover layers are controlled. Also, JP No. 3661812 describes a golf ball which has an inner/outer two-layer cover, wherein the inner layer is hard and the outer layer is soft.

However, these golf balls all have a somewhat hard feel on shots with a driver (W#1) or are unable to increase the distance to an adequate degree for mid-level amateur golfers and low head-speed golfers. Hence, the) cannot be regarded as golf balls that are fully satisfactory in terms of having both a good, soft feel at impact and achieving an increased distance on full shots.

SUMMARY OF THE INVENTION

It is therefore an object of the present invention to provide a golf ball which can achieve a distance on full shots with a driver that will satisfy not only professional golfers and skilled amateurs, but also mid-level golfers and low head-speed golfers, and which moreover is capable of imparting a good, soft feel at impact.

As a result of intensive investigations, the inventors have discovered that, in a golf ball having a core, an intermediate layer and a cover, by forming the cover (the outermost layer) of a polyurethane resin material that is somewhat hard and controlling within specific ranges the core deflection under specific loading, the melt flow rate (MFR) of the intermediate layer material, the thicknesses of the intermediate layer and cover, the Shore D hardness of the cover, the sum of the intermediate layer thickness and the cover thickness, and the value obtained by subtracting the Shore D hardness of the intermediate layer material from the Shore D hardness of the cover material, it is possible to impart such a golf ball with a good, soft feel at impact while also lowering the spin rate of the ball on full shots with a driver (W#1) and thereby achieving a good distance, and it is moreover possible to obtain a good scuff resistance even when the ball is struck with a grooved wedge.

Accordingly, the invention provides a multi-piece solid golf ball having a core of at least one layer, a cover of at least one layer, and at least one intermediate layer interposed between the core and the cover. The core has a deflection when compressed under a final load of 1,275 N (130 kgf) from an initial load state of 98 N (10 kgf) of at least 4.0 mm, the intermediate layer material has a melt flow rate (MFR) of at least 2.5 g/10 min, the intermediate layer has a thickness of from 1.0 to 1.8 mm, the cover is composed primarily of polyurethane, the cover has a thickness of from 0.5 to 1.0 mm, the cover has a Shore D hardness of at least 55, the sum of the intermediate layer thickness and the cover thickness is not more than 2.2 mm, and the value obtained by subtracting the Shore D hardness of the intermediate layer material from the Shore D hardness of the cover material is −10 or above.

In a preferred embodiment of the golf ball of the invention, the intermediate layer material has a Shore D hardness of from 60 to 65.

In another preferred embodiment, the ball has a surface hardness, expressed in terms of Shore D hardness, of from 58 to 68.

In yet another preferred embodiment, the (cover thickness)/(intermediate layer thickness) value is from 0.3 to 1.0.

In still another preferred embodiment, the core has a deflection when compressed under a final load of 1,275 N (130 kgf) from an initial load state of 98 N (10 kgf) of from 4.2 to 4.9 mm.

In a further preferred embodiment, letting CH be the deflection of the core when compressed under a final load of 1,275 N (130 kgf) from an initial load of 98 N (10 kgf) and BH be the deflection of the ball when compressed under a final load of 1,275 N (130 kgf) from an initial load of 98 N (10 kgf), the value CH−BH is preferably from 1.1 to 1.8 mm.

In an additional preferred embodiment, the value obtained by subtracting the cover thickness from the intermediate layer thickness is from 0.3 to 1.0 mm.

In yet another preferred embodiment, the core is formed of a rubber composition that includes: (a) a base rubber, (b) an α,β-unsaturated carboxylic acid and/or a metal salt thereof, (c) a crosslinking initiator, and (d) a metal carboxylate in which the carboxylic acid bonded to metal is of two or more different types and at least one of the carboxylic acids has 8 or more carbon atoms.

Advantageous Effects of the Invention

The golf ball of the invention has a good, soft feel at impact and lowers the rate of spin on full shots, achieving a good distance. Moreover, this golf ball can obtain a good scuff resistance even when hit with a grooved wedge.

BRIEF DESCRIPTION OF THE DIAGRAMS

FIG. 1 is a schematic cross-sectional view of a golf ball according to one embodiment of the invention.

DESCRIPTION OF THE PREFERRED EMBODIMENTS

The objects, features and advantages of the invention will become more apparent from the following detailed description taken in conjunction with the appended diagram.

The multi-piece solid golf ball of the invention has, in order from the inside thereof, a core, an intermediate layer and a cover. For example, referring to FIG. 1, the golf ball G has a core 1, an intermediate layer 2 encasing the core 1, and a cover 3 encasing the intermediate layer 2. In addition, the golf ball typically has numerous dimples D formed on the outer surface of the cover 3 in order to enhance the aerodynamic properties. Each layer is described in detail below.

The core is preferably made of a material that is composed primarily of rubber. For example, use may be made of a rubber composition obtained by compounding a base rubber as the primary component, a crosslinking initiator, a co-crosslinking agent, an inert filler and, optionally, an organo-sulfur compound.

Polybutadiene is preferably used as the base rubber. The polybutadiene has a cis-1,4 bond content on the polymer chain of typically at least 60 wt %, preferably at least 80 wt %, more preferably at least 90 wt %, and most preferably at least 95 wt %. When the content of cis-1,4 bonds among the bonds on the polybutadiene molecule is too low, the resilience may decrease.

Rubber components other than this polybutadiene may be included in the base rubber within a range that does not detract from the advantageous effects of the invention. Examples of such rubber components other than the foregoing polybutadiene include other polybutadienes, and diene rubbers other than polybutadiene, such as styrene-butadiene rubber, natural rubber, isoprene rubber and ethylene-propylene-diene rubber.

An organic peroxide may be suitably used as the crosslinking initiator. This organic peroxide is not particularly limited, although the use of an organic peroxide having a one-minute half-life temperature of between 110 and 185° C. is preferred. One, two or more organic peroxides may be used. The content of organic peroxide per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercial product may be used as the organic peroxide. Specific examples include those available under the trade names Percumyl D, Perhexa C-40, Niper BW and Peroyl L (all from NOF Corporation), and Luperco 231XL (from Atochem Co.).

The co-crosslinking agent is exemplified by unsaturated carboxylic acids and the metal salts of unsaturated carboxylic acids. Illustrative examples of unsaturated carboxylic acids include acrylic acid, methacrylic acid, maleic acid and fumaric acid. Acrylic acid and methacrylic acid are especially preferred. Metal salts of unsaturated carboxylic acids are not particularly limited, and are exemplified by those obtained by neutralizing the foregoing unsaturated carboxylic acids with the desired metal ions. Illustrative examples include the zinc salts and magnesium salts of methacrylic acid and acrylic acid. The use of zinc acrylate is especially preferred.

These unsaturated carboxylic acids and/or metal salts thereof are included in an amount per 100 parts by weight of the base rubber which is typically at least 10 parts by weight, preferably at least 15 parts by weight, and more preferably at least 20 parts by weight. The upper limit is typically not more than 60 parts by weight, preferably not more than 50 parts by weight, more preferably not more than 45 parts by weight, and most preferably not more than 40 parts by weight. When too much is included, the feel of the ball may become too hard and unpleasant. When too little is included, the rebound may decrease.

In one embodiment of the core used in this invention, the core may be formed of a rubber composition that includes: (a) a base rubber, (b) an α,β-unsaturated carboxylic acid and/or a metal salt thereof, (c) a crosslinking initiator, and (d) a metal carboxylate in which the carboxylic acid bonded to metal is of two or more different types and at least one of the carboxylic acids has 8 or more carbon atoms. These components (a), (b) and (c) are the same as, respectively, the base rubber, the unsaturated carboxylic acid and/or metal salt thereof, and the crosslinking initiator described above.

Component (d) is described below.

(d) Metal Carboxylate

Component (d) is a metal carboxylate in which the carboxylic acid bonded to metal is of two or more different types and at least one of the carboxylic acids has 8 or more carbon atoms. As used herein, "bond" refers to a bond between a metal and a carboxylic acid; the number of bonds varies depending on the metal species. Specifically, sodium and potassium have one bonding site, zinc and calcium have two, and iron and aluminum have three. Because the number of bonding sites on the metal must be two or more in order for the metal carboxylate to be able to serve as component (d) in this invention, the metal species is limited to those have two or more bonding sites. In the case of a zinc salt, for example, letting one of the two bonding sites on zinc be a carboxylic acid A having 8 or more carbon atoms, the second carboxylic acid must be one other than carboxylic acid A. Such carboxylic acids are denoted herein with names having the prefix "mono" to distinguish them from metal salts with two bonds (disalts) in which the carboxylic acids bonded to the metal are both the same, such as zinc stearate. Illustrative examples of component (d) include compounds of structural formula (1) or (2) below.

$$R^1\text{-}M^1\text{-}R^2 \tag{1}$$

In formula (1), $R^1$ and $R^2$ are each different carboxylic acids, with at least one of $R^1$ and $R^2$ having 8 or more carbon atoms. $M^1$ represents a divalent metal atom.

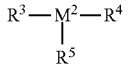

(2)

In formula (2), $R^3$ to $R^5$ are two or more different carboxylic acids, with at least one of $R^3$ to $R^5$ having 8 or more carbon atoms. $M^2$ represents a trivalent metal atom.

By having component (d) be two or more different carboxylic acids bonded to a metal, with at least one of the carboxylic acids having 8 or more carbon atoms, the processability can be improved and the decrease in the initial velocity of the core owing to the addition of component (d) can be held to a minimum.

In component (d), it is preferable for at least one of the carboxylic acids bonded to the metal to be an unsaturated carboxylic acid, and more preferable for the unsaturated carboxylic acid to be an α,β-unsaturated carboxylic acid having from 3 to 8 carbon atoms. Also, it is especially preferable for the metal species in the metal carboxylate of component (d) to be one selected from the group consisting of zinc, calcium, magnesium, copper, aluminum, iron and zirconium.

Illustrative examples of component (d) include zinc monostearate monopalmitate, zinc monostearate monomyristate, zinc monostearate monolaurate, zinc monopalmitate monomyristate, zinc monopalmitate monolaurate, zinc monostearate monoacrylate, zinc monostearate monomethacrylate, zinc monostearate monomaleate, zinc monostearate monofumarate, zinc monopalmitate monoacrylate, zinc monopalmitate monomethacrylate, zinc monopalmitate monomaleate, zinc monopalmitate monofumarate, zinc monomyristate monoacrylate, zinc monomyristate monomethacrylate, zinc monomyristate monomaleate, zinc monomyristate monofumarate, zinc monolaurate monoacrylate, zinc monolaurate monomethacrylate, zinc monolaurate monomaleate and zinc monolaurate monofumarate. Zinc monostearate monoacrylate is preferred. Cases where the carboxylic acids bonded to the metal are the same, such as zinc stearate, do not fall within the scope of this invention.

The form of component (d) in the rubber composition is not particularly limited. For example, it may be present in a form that is mixed and dispersed, within the rubber composition, together with the α,β-unsaturated carboxylic acid or a metal salt thereof serving as component (b). Another form is one in which the surface of component (b), especially a metal salt of an α,β-unsaturated carboxylic acid such as zinc acrylate, is coated with component (d). That is, component (d) may be included in the rubber composition as a coating layer on component (b).

Component (d) can be easily obtained by reacting a metal compound in the presence of a plurality of carboxylic acids. Specifically, in the case of zinc monostearate monoacrylate, this can be obtained by dissolving stearate acid and acrylic acid in a reaction solution and mixing therein zinc oxide suspended in a solvent so as to induce the reaction. Alternatively, it can be obtained by adding stearic acid and acrylic acid to a solution obtained by suspending zinc oxide in a solvent.

The content of component (d) per 100 parts by weight of the base rubber is preferably from 0.1 to 50 parts by weight, and more preferably from 1 to 25 parts by weight. The weight ratio of component (d) to component (b) is preferably from 1 to 99 wt %, and more preferably from 4 to 50 wt %. At a component (d) content lower than this range, a sufficient processability improving effect may not be obtainable. On the other hand, at a component (d) content higher than this range, the initial velocity of the core may decrease more than necessary.

The core in this invention can be obtained by vulcanizing/curing the above-described rubber composition by a method similar to that used for conventional golf ball rubber compositions. Vulcanization is carried out under conditions exemplified by a vulcanization temperature of between 100 and 200° C. and a vulcanization time of from 5 to 40 minutes.

It is recommended that the core have a diameter of preferably at least 38.3 mm, more preferably at least 38.4 mm, and even more preferably at least 38.5 mm, with the upper limit being preferably not more than 39.7 mm, more preferably not more than 39.3 mm, and even more preferably not more than 39.0 mm. At a diameter smaller than this, it may be difficult to obtain a sufficient spin rate-lowering effect and resilience. On the other hand, at a diameter larger than this value, a sufficient spin rate-lowering effect may not be obtained and the advantageous effects imparted by the cover may not be obtained.

The core has a deflection (mm) when compressed under a final load of 1,275 N (130 kgf) from an initial load of 98 N (10 kgf) which, although not particularly limited, is to preferably from 4.0 to 5.1 mm, more preferably from 4.2 to 4.9 mm, and even more preferably from 4.4 to 4.7 mm. When this value is too large, the resilience may be too low, shortening the distance traveled by the ball, the feel at impact may be too soft, and the durability of the ball to repeated impact may worsen. On the other hand, when this value is too small, the spin rate may rise excessively, possibly shortening the distance traveled by the ball, and the feel at impact may be too hard.

The core has a surface hardness Cs which, expressed in terms of JIS-C hardness, is preferably from 68 to 80, more preferably from 70 to 78, and even more preferably from 72 to 76. When this MS-C hardness value for the core surface hardness is too large, the feel at impact may harden and the durability of the ball to cracking under repeated impact may worsen. On the other hand, when this value is too small, the resilience may become lower, possibly shortening the distance traveled by the ball, and the durability of the ball to repeated impact may worsen.

The core has a center hardness Cc which, expressed in terms of JIS-C hardness, is preferably from 50 to 63, more preferably from 52 to 61, and even more preferably from 54 to 59. When this JIS-C hardness value for the core center hardness is too large, the spin rate may rise excessively, possibly shortening the distance traveled by the ball and the feel at impact may become hard. On the other hand, when this value is too small, the durability to cracking on repeated impact may worsen and the feel at impact may become too soft.

The hardness difference between the surface and center of the core, i.e., the value Cs−Cc, is preferably from 10 to 26, more preferably from 13 to 24, and even more preferably from 15 to 22. When this hardness difference is too large, the durability of the ball to cracking under repeated impact may worsen. On the other hand, when this hardness difference is too small, the spin rate may rise excessively, possibly shortening the distance traveled by the ball.

The center hardness Cc is a cross-sectional hardness which refers to the hardness measured at the center of the cross-section obtained by cutting the core in half through the center. The surface hardness Cs refers to the hardness measured at the spherical surface of the core.

Next, the resin material used in the intermediate layer is described.

The intermediate layer material is not particularly limited, although an ionomer resin material or a highly neutralized resin material is preferably used. Illustrative examples include sodium-neutralized ionomer resins such as Himilan® 1605, Himilan® 1601 and Surlyn® 8120; and zinc-neutralized ionomer resins such as Himilan® 1557 and Himilan® 1706. These may be used singly or two or more may be used together.

When an ionomer resin is used as the intermediate layer material, the content of unsaturated carboxylic acid (acid content) included in the intermediate layer material is generally at least 10 wt %, and preferably at least 15 wt %, with the upper limit being not more than 25 wt %, and preferably not more than 20 wt %. When the acid content is low, the resilience decreases or the spin rate increases, as a result of which a good distance may not be obtained. When the acid content is high, the processability may decrease or the durability to cracking under repeated impact may worsen.

The melt flow rate (MFR) of the resin material used to form the intermediate layer is adjusted within a specific range. That is, the MFR of the resin material for the intermediate layer is at least 2.5 g/10 mm, preferably at least 2.6 g/10 min, and more preferably at least 2.7 g/10 min. It is recommended that the upper limit be set to preferably not more than 5.0 g/10 min, and more preferably not more than 4.0 g/10 min. When the melt flow rate is too small, the processability may markedly decrease and the resin material cannot be made to spread entirely around the core unless the molding temperature is increased, as a result of which the durability of the ball to cracking may worsen. The measurement method involves measuring the resin flow rate at a test temperature of 190° C. and under a test load of 21.18 N (2.16 kgf) in general accordance with JIS K-6760.

The surface of the intermediate layer formed from this intermediate layer material is preferably abraded in order to increase adhesion with the polyurethane used as the primary material of the subsequently described cover. In addition, following such abrasion treatment, it is preferable to either apply a primer (adhesive) to the surface of the intermediate layer or to add an adhesion promoter to the material.

The intermediate layer material has a specific gravity which is generally less than 1.1, preferably from 0.90 to 1.05, and more preferably from 0.93 to 0.99. At a specific gravity outside of this range, the ball resilience decreases, as a result of which a good distance may not be achieved, or the durability to cracking under repeated impact may worsen.

The intermediate layer material has a hardness, expressed in terms of Shore D hardness, which, although not particularly limited, is preferably at least 56, more preferably at least 58, and even more preferably at least 60, with the upper limit being preferably not more than 67, more preferably not more than 65, and even more preferably not more than 63. Also the sphere encased by the intermediate layer (referred to below as the "intermediate layer-encased sphere") has a surface hardness, expressed in terms of Shore D hardness, which is preferably at least 62, more preferably at least 64, and even more preferably at least 66, with the upper limit being preferably not more than 73, more preferably not more than 71, and even more preferably not more than 69. When the intermediate layer material or intermediate layer-encased sphere is softer than the respective above hardness ranges, the ball is too receptive to spin on full shots, as a result of which a good distance may not be achieved. On the other hand, when the ball is harder than the above hardness range, the durability to cracking on repeated impact may worsen, or the ball may have too hard a feel at impact on shots with a putter or on approach shots.

The intermediate layer has a thickness which, although not particularly limited, is preferably at least 1.0 mm, more preferably at least 1.1 mm, and even more preferably at least 1.2 mm, with the upper limit being preferably not more than 1.8 mm, more preferably not more than 1.6 mm, and even more preferably not more than 1.5 mm. It is desirable for the intermediate layer to be formed so as to be thicker than the subsequently described cover. When the thickness of the intermediate layer falls outside of the above numerical range or the intermediate layer is formed so as to be thinner than the cover, the spin rate-lowering effect on shots with a driver (W#1) is inadequate, as a result of which a good distance may not be achieved.

Next, the cover serving as the outermost layer of the ball is described.

The cover (outermost layer) material is not particularly limited; various types of thermoplastic resin materials may be suitably used. For reasons having to do with ball controllability and scuff resistance, a polyurethane material is used as the primary material of the cover. In particular, from the standpoint of the mass productivity of the manufactured golf ball, it is preferable to use a cover material composed primarily of a thermoplastic polyurethane, with formation more preferably being carried out using a resin blend in which the primary components are (O) a thermoplastic polyurethane and (P) a polyisocyanate compound.

In the thermoplastic polyurethane composition containing above components (O) and (P), to improve the ball properties even further, a necessary and sufficient amount of unreacted isocyanate groups should be present in the cover resin material. Specifically, it is to recommended that the combined weight of above components (O) and (P) be at least 60%, and more preferably at least 70%, of the weight of the overall cover layer. Components (O) and (P) are described below in detail.

The thermoplastic polyurethane (O) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic diol having 2 to 12 carbons, and more preferably 1,4-butylene glycol.

Any polyisocyanate compound hitherto employed in the art relating to thermoplastic polyurethanes may be suitably used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reactions during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (O). Illustrative examples include Pandex T-8295, T-8290, T-8283 and T-8260 (all from DIC Bayer Polymer, Ltd.).

Although not an essential ingredient, a thermoplastic elastomer other than the above thermoplastic polyurethane may be included as an additional component together with components (O) and (P). By including this component (Q) in the above resin blend, a further improvement in the flowability of the resin blend can be achieved and the properties required of a golf ball cover material, such as resilience and scuff resistance, can be enhanced.

The relative proportions of above components (O), (P) and (Q) are not particularly limited. However, to fully elicit the desirable effects of the invention, the weight ratio (O):(P):(Q) is preferably from 100:2:50 to 100:50:0, and more preferably from 100:2:50 to 100:30:8.

In addition to the ingredients making up the thermoplastic polyurethane, various additives may be optionally included in the above resin blend. For example, pigments, dispersants, antioxidants, light stabilizers, ultraviolet absorbers and internal mold lubricants may be suitably included.

The cover (outermost layer) has a material hardness, expressed in terms of Shore D hardness, which, although not particularly limited, is preferably at least 55, more preferably at least 56, and even more preferably at least 57, with the upper limit being preferably not more than 62, more preferably not more than 60, and even more preferably not more than 58. Also, the surface hardness of the cover-encased sphere, i.e., the surface hardness of the ball as a whole, expressed in terms of Shore D hardness, is preferably at least 61, more preferably at least 62, and even more preferably at least 63, with the upper limit being preferably not more than 68, more preferably not more than 66, and even more preferably not more than 64. When the surface hardness is softer than this range, the spin rate on driver (W#1) shots or on full shots with an iron becomes too high, as a result of which a good distance may not be achieved. On the other hand, when the surface hardness is harder than this range, on shots with a grooved wedge, the scuff resistance may become poor or the feel on impact may become too hard.

The cover (outermost layer) has a thickness which, although not particularly limited, is preferably at least 0.5 mm, more preferably at least 0.6 mm, and even more preferably at least 0.7 mm, with the upper limit being preferably not more than 1.0 mm, more preferably not more than 0.9 mm, and even more preferably not more than 0.8 mm. A cover that is thicker than this range may result in an inadequate resilience and a higher spin rate on W#1 shots and shots with an iron, as a result of which a good distance may not be obtained. On the other hand, when the cover is thinner than the above range, the scuff resistance may worsen; in particular, the feel at impact in the short game, such as on shots with a putter, may become hard.

The cover (outermost layer)-encased sphere. i.e., the ball, has a deflection (mm) when compressed under a final load of 1,275 N (130 kgf) from an initial load of 98 N (10 kgf) which, although not particularly limited, is preferably from 2.4 to 3.7 mm, more preferably from 2.6 to 3.5 mm, and even more preferably from 2.8 to 3.3 mm. When this value is too large, the feel at impact may be too soft, the durability on repeated impact may worsen, or the initial velocity on full shots may decrease, as a result of which the intended distance may not be obtained. On the other hand, when this value is too small, the feel at impact may become too hard or the spin rate on full shots may become too high, as a result of which the intended distance may not be obtained.

The manufacture of multi-piece solid golf balls in which the above-described core, intermediate layer and cover (outermost layer) are formed as successive layers may be carried out by a customary method such as a known injection-molding process. For example, a multi-piece golf ball may be obtained by placing, as the core, a molded and cross-linked material composed primarily of a rubber material in a given injection mold, injecting an intermediate layer material over the core to give an intermediate sphere, and subsequently placing the intermediate sphere in another injection mold and injection-molding a cover (outermost layer) material over the sphere. Alternatively, a cover (outermost layer) may be formed over the intermediate layer by a method that involves encasing the intermediate sphere with a cover, this being carried out by, for example, enclosing the intermediate sphere within two half-cups that have been pre-molded into hemispherical shapes, and then molding under applied heat and pressure.

The golf ball of the invention preferably satisfies the following conditions.

(I) Relationship Between Core Deflection and Ball Deflection Under Specific Loading The relationship between the core deflection and the ball deflection under specific loading is optimized within a given range. Letting CH be the deflection (mm) of the core when compressed under a final load of 1,275 N from an initial load of 98N and BH be the deflection (mm) of the golf ball when compressed under a final load of 1,275 N from an initial load of 98 N, the value CH−BH is preferably from 1.0 to 2.0 mm, more preferably from 1.1 to 1.8 mm, and even more preferably from 1.2 to 1.6 mm. When this value is too large, the durability to cracking under repeated impact may worsen and the feel at impact on full shots may become too soft. On the other hand, when this value is too small, the spin rate on full shots may rise excessively, as a result of which the intended distance may not be achieved.

(II) Thickness Relationship Between Intermediate Layer and Cover

The relationship between the thickness of the intermediate layer and the thickness of the cover is set within a given range. That is, the value obtained by subtracting the cover thickness from the intermediate layer thickness is preferably from 0 to 2.0 mm, more preferably from 0.1 to 1.5 mm, and even more preferably from 0.3 to 1.0 mm. When this value is too large, the feel at impact may become too hard or the core may become too soft, possibly resulting in a poor durability to cracking on repeated impact. On the other hand, when this value is too small, the spin rate on full shots may become too high, as a result of which the intended distance may not be obtained.

The sum of the intermediate layer thickness and the cover thickness is preferably at least 1.6 mm, more preferably from 1.8 to 2.2 mm, and even more preferably from 2.0 to 2.1 mm. When this combined thickness is too large, the spin rate of full shots becomes too large, as a result of which the intended distance cannot be achieved. On the other hand, when this value is too small, the durability on repeated impact may worsen.

In addition, the (cover thickness)/(intermediate layer thickness) value is preferably from 0.3 to 1.0, more preferably from 0.4 to 0.8, and even more preferably from 0.5 to 0.7. When this value is too large, the spin rate on full shots becomes too high, as a result of which the intended distance may not be obtained. On the other hand, when this value is too small, the scuff resistance may be poor or the feel at impact may become too hard.

The value obtained by subtracting the Shore D hardness of the intermediate layer material from the Shore D hardness of the cover material is preferably from −10 to 0, more preferably from −8 to −2, and even more preferably from −6 to −4. When this value is too large, the scuff resistance may become poor. On the other hand, when this value is too small, the spin rate on full shots may become too high, as a result of which the intended distance may not be obtained.

Numerous dimples may be formed on the outer surface of the cover (outermost layer). The number of dimples arranged on the cover surface, although not particularly limited, may be set to preferably at least 280, more preferably at least 300, and even more preferably at least 320, with the upper limit being preferably not more than 360, more preferably not more than 350, and even more preferably not more than 340. When the number of dimples is higher than this range, the ball trajectory may become low, as a result of which the distance may decrease. On the other hand, when the number of dimples is lower than this range, the ball trajectory may become high, as a result of which a good distance may not be achieved.

The dimple shapes that are used may be of one type or may be a combination of two or more types selected from among circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to about 0.30 mm.

In order to fully manifest the aerodynamic properties, it is desirable for the surface coverage ratio of dimples on the spherical surface of the golf ball, i.e., the ratio SR of the sum of the individual dimple surface areas, each defined by the flat plane circumscribed by the edge of a dimple, with respect to the spherical surface area of the ball were it to have no dimples thereon, to be set to at least 60% and up to 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and up to 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to at least 0.6% and up to 1.0%. Outside of the above ranges in these respective values, the resulting trajectory may not enable a good distance to be obtained, and so the ball may fail to travel a fully satisfactory distance.

The multi-piece solid golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 to 4, Comparative Examples 1 to 8

Formation of Core

Cores for each Working Example of the invention and each Comparative Example were produced by preparing the rubber compositions shown in Table 1 below, then molding and vulcanizing the compositions under vulcanization conditions of 157° C. and 15 minutes.

TABLE 1

| Core formulations | Working Example | | | | Comparative Example | | | | | | | |
|---|---|---|---|---|---|---|---|---|---|---|---|---|
| (pbw) | 1 | 2 | 3 | 4 | 1 | 2 | 3 | 4 | 5 | 6 | 7 | 8 |
| Polybutadiene A | 50 | 50 | 50 | 50 | 50 | 50 | 50 | 50 | 50 | 50 | 50 | 50 |
| Polybutadiene B | 50 | 50 | 50 | 50 | 50 | 50 | 50 | 50 | 50 | 50 | 50 | 50 |
| Unsaturated metal carboxylate | 25.3 | 23.3 | 25.3 | 23.3 | 25.3 | 31.5 | 25.3 | 25.3 | 25.3 | 25.3 | 25.3 | 23.3 |
| Metal carboxylate 1 | | | 3.9 | 3.9 | | | | | | | | |
| Metal carboxylate 2 | 3.9 | 3.9 | | | 3.9 | 3.9 | 3.9 | 3.9 | 3.9 | 3.9 | 3.9 | 3.9 |
| Organic peroxide (1) | 0.3 | 0.3 | 0.3 | 0.3 | 0.3 | 0.3 | 0.3 | 0.3 | 0.3 | 0.3 | 0.3 | 0.3 |
| Organic peroxide (2) | 0.3 | 0.3 | 0.3 | 0.3 | 0.3 | 0.3 | 0.3 | 0.3 | 0.3 | 0.3 | 0.3 | 0.3 |
| Antioxidant | 0.1 | 0.1 | 0.1 | 0.1 | 0.1 | 0.1 | 0.1 | 0.1 | 0.1 | 0.1 | 0.1 | 0.1 |
| Barium sulfate | 18.6 | 19.5 | 18.6 | 19.5 | 22.0 | 15.9 | 18.6 | 17.7 | 30.5 | 15.8 | 23.1 | 19.5 |
| Zinc oxide | 4 | 4 | 4 | 4 | 4 | 4 | 4 | 4 | 4 | 4 | 4 | 4 |
| Zinc salt of pentachlorothiophenol | 0.5 | 0.5 | 0.5 | 0.5 | 0.5 | 0.3 | 0.5 | 0.5 | 0.5 | 0.5 | 0.5 | 0.5 |
| Productivity | good | good | Exc | Exc | good | good | good | good | good | good | good | good |

Details on the ingredients shown in Table 1 are given below. Numbers in the table indicate parts by weight.

Polybutadiene A: Available under the trade name "BR 51" from JSR Corporation

Polybutadiene B: Available under the trade name "BR 730" from JSR Corporation

Unsaturated metal carboxylate: Zinc acrylate (Wako Pure Chemical Industries, Ltd.)

Metal carboxylate 1: Zinc monoacrylate monostearate (available from Nippon Shokubai Co., Ltd.)

Metal carboxylate 2: Zinc stearate (available from Wako Pure Chemical Industries, Ltd.)

Organic peroxide (1): Dicumyl peroxide, available under the trade name "Percumyl D" from NOF Corporation Organic peroxide (2): A mixture of 1,1-di(t-butylperoxy) cyclohexane and silica, available under the trade name "Perhexa C-40" from NOF Corporation Antioxidant: 2,2'-Methylenebis(4-methyl-6-butylphenol), available under the trade name "Nocrac NS-6" from Ouchi Shinko Chemical Industry Co., Ltd.

The core productivity for each Example was evaluated according to the following criteria. The results are presented in the above table.

Productivity

During mixing and extrusion of the rubber composition, the following were evaluated: (i) mixing time, (ii) sticking to inner wall of mixing apparatus, (iii) residue, (iv) coherence of rubber composition following mixture, and (v) surface roughness of rubber composition when extruded. These were judged collectively as being indicative of very high productivity (Exc), high productivity (Good), or low productivity (NG).

Formation of Intermediate Layer and Cover

Next, the intermediate layer and the cover were successively injection-molded from the blends of resin materials I to V shown in Table 2 below over the core obtained above, thereby producing three-piece solid golf balls. Although not shown in the diagram, a common dimple pattern was formed on the surface of the ball in each Working Example and Comparative Example.

TABLE 2

| | Cover formulations (pbw) | | | | |
|---|---|---|---|---|---|
| Intermediate layer | I | II | III | IV | V |
| T-8295 | | 100 | | | |
| T-8290 | | | | 100 | |
| Himilan ® 1706 | 35 | | | | 50 |
| Himilan ® 1557 | 15 | | | | |
| Himilan ® 1605 | 50 | | | | 50 |
| Himilan ® 1855 | | | 50 | | |
| Himilan ® 1601 | | | 50 | | |
| Hytrel ® 4001 | | 11 | | 11 | |
| Titanium oxide | | 3.9 | 2.1 | 3.9 | |
| Polyethylene wax | | 1.2 | | 1.2 | |
| Isocyanate compound | | 7.5 | | 7.5 | |
| Trimethylolpropane | 1.1 | | | | |
| Magnesium stearate | | | 1 | | |
| MFR (g/10 min)[1)] | 2.7 | NM[2)] | 1.1 | NM[2)] | 1.9 |

[1)]Melt flow rate (MFR) values in the table were measured based on JIS K-6760.
[2)]NM = not measurable. The value was too large to be measured.

Trade names and other details on the materials shown in Table 2 are as follows.

T-8290, T-8295: MDI-PTMG type thermoplastic polyurethanes available from DIC Bayer Polymer under the trademark Pandex.

Himilan®: Ionomers available from DuPont-Mitsui Polychemicals Co., Ltd.

Hytrel®: A thermoplastic polyether ester elastomer available from DuPont-Toray Co., Ltd.

Polyethylene wax: Available as "Sanwax 161P" from Sanyo Chemical Industries, Ltd.

Isocyanate compound: 4,4'-Diphenylmethane diisocyanate

For each of the golf balls obtained, properties such as the cross-sectional hardness of the core, the core diameter, the thickness and material hardness of each layer, and the surface hardness of each encased sphere were evaluated by the following methods. The results are shown in Table 3.

Diameter of Core and Intermediate Layer-Encased Sphere

The diameters at five random places on the surface were measured at a temperature of 23.9±1° C. and, using the average of these measurements as the measured value for a single core or intermediate layer-encased sphere, the average diameter for five measured to cores or intermediate layer-encased spheres was determined.

Ball Diameter

The diameters at five random dimple-free areas on the surface of a ball were measured at a temperature of 23.9±1° C. and, using the average of these measurements as the measured value for a single ball, the average diameter for five measured balls was determined.

Deflection of Core and Ball

A core or ball was placed on a hard plate and the amount of deflection when compressed under a final load of 1,275 N (130 kgf) from an initial load of 98 N (10 kgf) was measured. The amount of deflection here refers in each case to the measured value obtained after holding the test specimen isothermally at 23.9° C.

Center and Surface Hardnesses of Core (JIS-C Hardness)

The core center hardness was obtained by cutting the core in half through the center and measuring the hardness at the center of the resulting cross-section. The core surface hardness was obtained by perpendicularly pressing the indenter of a durometer against the surface of the spherical core and measuring the hardness. Both hardnesses are measured with the spring-type durometer (JIS-C model) specified in JIS K 6301-1975.

Surface Hardnesses of Intermediate Layer-Encased Sphere and Ball (Shore D Hardness)

Measurements were taken by pressing the durometer indenter perpendicularly against the surface of the intermediate layer-encased sphere or of the ball (i.e., the surface of the cover). The surface hardness of the ball (cover) is the measured value obtained at dimple-free places (lands) on the ball surface. The Shore D hardnesses were measured with a type D durometer in accordance with ASTM D2240-95.

Material Hardnesses of Intermediate Layer and Cover (Shore D Hardness)

The intermediate layer-forming and cover-forming resin materials were molded into sheets having a thickness of 2 mm and left to stand for at least two weeks, following which the Shore D hardnesses were measured in accordance with ASTM D2240-95.

TABLE 3

| | | Working Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| Construction | | 3-piece | 3-piece | 3-piece | 3-piece | 3-piece | 3-piece | 3-piece | 3-piece | 3-piece | 3-piece | 3-piece | 3-piece |
| Core | Diameter (mm) | 38.5 | 38.5 | 38.5 | 38.5 | 38.5 | 38.5 | 38.5 | 39.3 | 37.7 | 39.5 | 37.1 | 38.5 |
| | Weight (g) | 34.8 | 34.8 | 34.8 | 34.8 | 35.3 | 34.8 | 34.8 | 36.8 | 34.5 | 37.0 | 31.8 | 34.8 |
| | Specific gravity | 1.163 | 1.163 | 1.163 | 1.163 | 1.182 | 1.163 | 1.163 | 1.158 | 1.229 | 1.147 | 1.188 | 1.163 |
| | Deflection (mm) | 4.3 | 4.6 | 4.3 | 4.6 | 4.3 | 3.2 | 4.3 | 4.3 | 4.3 | 4.3 | 4.3 | 4.6 |
| | Surface JIS-C hardness (Cs) | 75 | 73 | 74 | 72 | 75 | 79 | 75 | 75 | 75 | 75 | 75 | 73 |
| | Center JIS-C hardness (Cc) | 58 | 55 | 57 | 55 | 58 | 66 | 58 | 58 | 58 | 58 | 58 | 55 |
| | Surface − Center (Cs − Cc) | 17 | 18 | 17 | 17 | 17 | 13 | 17 | 17 | 17 | 17 | 17 | 18 |
| Intermediate layer | Type of material | I | I | I | I | I | I | I | I | I | I | I | V |
| | Thickness (min) | 1.3 | 1.3 | 1.3 | 1.3 | 1.3 | 1.3 | 1.3 | 1.3 | 1.3 | 0.8 | 2.0 | 1.3 |
| | Specific gravity | 0.95 | 0.95 | 0.95 | 0.95 | 0.95 | 0.95 | 0.95 | 0.95 | 0.95 | 0.95 | 0.95 | 0.95 |
| | Shore D hardness of material | 62 | 62 | 62 | 62 | 62 | 62 | 62 | 62 | 62 | 62 | 62 | 63 |

TABLE 3-continued

| | | Working Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| Intermediate layer-encased sphere | Diameter (mm) | 41.1 | 41.1 | 41.1 | 41.1 | 41.1 | 41.1 | 41.1 | 41.9 | 40.3 | 41.1 | 41.1 | 41.1 |
| | Weight (g) | 40.9 | 40.9 | 40.9 | 40.9 | 41.5 | 40.9 | 40.9 | 43.2 | 38.6 | 40.9 | 40.9 | 40.9 |
| | Shore D hardness at surface | 68 | 68 | 68 | 68 | 68 | 68 | 68 | 68 | 68 | 68 | 68 | 69 |
| Cover | Type of material | II | II | II | II | III | I | IV | II | II | II | II | II |
| | Thickness (mm) | 0.8 | 0.8 | 0.8 | 0.8 | 0.8 | 0.8 | 0.8 | 0.4 | 1.2 | 0.8 | 0.8 | 0.8 |
| | Specific gravity | 1.12 | 1.12 | 1.12 | 1.12 | 0.98 | 1.12 | 1.12 | 1.12 | 1.12 | 1.12 | 1.12 | 1.12 |
| | Shore D hardness of material | 57 | 57 | 57 | 57 | 57 | 57 | 50 | 57 | 57 | 57 | 57 | 57 |
| Ball | Diameter (mm) | 42.7 | 42.7 | 42.7 | 42.7 | 42.7 | 42.7 | 42.7 | cover layer could not be injection-molded (could not be formed) | 42.7 | 42.7 | 42.7 | 42.7 |
| | Weight (g) | 45.5 | 45.5 | 45.5 | 45.5 | 45.5 | 45.5 | 45.5 | | 45.5 | 45.5 | 45.5 | 45.5 |
| | Deflection (mm) | 2.9 | 3.1 | 2.9 | 3.1 | 2.9 | 2.3 | 3.0 | | 3.2 | 3.0 | 2.7 | 3.0 |
| | Shore D hardness at surface | 63 | 63 | 63 | 63 | 63 | 63 | 56 | | 62 | 63 | 63 | 63 |
| Cover material hardness − Intermediate layer material hardness (Shore D) | | −5 | −5 | −5 | −5 | −5 | −5 | −12 | | −5 | −5 | −5 | −6 |
| Ball surface hardness − Intermediate layer surface hardness (Shore D) | | −5 | −5 | −5 | −5 | −5 | −5 | −12 | | −6 | −5 | −5 | −6 |
| Intermediate layer thickness − Cover thickness (mm) | | 0.5 | 0.5 | 0.5 | 0.5 | 0.5 | 0.5 | 0.5 | | 0.1 | 0 | 1.2 | 0.5 |
| Cover thickness/Intermediate layer thickness | | 0.62 | 0.62 | 0.62 | 0.62 | 0.62 | 0.62 | 0.62 | | 0.92 | 1.00 | 0.40 | 0.62 |
| Core deflection − Ball deflection (mm) | | 1.4 | 1.5 | 1.4 | 1.5 | 1.4 | 0.9 | 1.3 | | 1.1 | 1.3 | 1.6 | 1.6 |
| Cover thickness + Intermediate layer thickness (mm) | | 2.1 | 2.1 | 2.1 | 2.1 | 2.1 | 2.1 | 2.1 | — | 2.5 | 1.6 | 2.8 | 2.1 |

The flight performance, feel at impact, scuff resistance and durability of each golf ball were evaluated by the following methods. The results are shown in Table 4. These measurements were all carried out in a 23° C. environment.

Flight Performance

A driver (W#1) was mounted on a golf swing robot, the distance traveled by the ball when struck at a head speed (HS) of 40 m/s was measured, and the flight performance was rated according to the criteria shown below. The club used was the J715 B3 (2014 model) manufactured by Bridgestone Sports Co., Ltd. The spin rate of the ball immediately after being struck was measured with an apparatus for measuring the initial conditions.

Rating Criteria:

Good: Total distance was 190.0 m or more

NG: Total distance was less than 190.0 m

Feel of Ball

The balls were hit with a driver (W#1) by amateur golfers having head speeds of 35 to 45 m/s, and sensory evaluations were carried out under the following criteria.

Rating Criteria:

Good: Six or more of the ten golfers experienced a good feel at impact

Fair: Three to five of the ten golfers experienced a good feel at impact

NG: Two or fewer of the ten golfers experienced a good feel at impact

Scuff Resistance

A non-plated pitching sand wedge was set in a swing robot and the ball was hit once at a head speed (HS) of 35 m/s, following which the surface state of the ball was visually examined and rated as follows.

Rating Criteria:

Good: The ball can still be used.

NG: The ball can no longer be used.

Durability

The balls in the respective Examples were repeatedly struck at a head speed (HS) of 40 m/s with a driver (W#1). The durability index in each Example was calculated relative to an arbitrary index of 100 for the number of shots at which the ball in Example 2 began to crack, and the durability was rated according to the following criteria.

Rating Criteria:

Good: Durability index was 95 or more

NG: Durability index was less than 95

TABLE 4

| | | | Working Example | | | | Comparative Example | | | | | | |
|---|---|---|---|---|---|---|---|---|---|---|---|---|---|
| | | | 1 | 2 | 3 | 4 | 1 | 2 | 3 | 5 | 6 | 7 | 8 |
| Flight performance | W#1 HS, 40 m/s | Spin rate (rpm) | 2,735 | 2,650 | 2,730 | 2,630 | 2,788 | 2,855 | 2,865 | 2,839 | 2,829 | 2,810 | 2,630 |
| | | Total distance (m) | 192.9 | 192.0 | 193.1 | 192.5 | 192.3 | 192.6 | 189.3 | 189.7 | 189.8 | 191.5 | 192.4 |
| | | Rating | good | good | good | good | good | good | NG | NG | NG | good | good |
| Feel at impact | | Rating | good | good | good | good | good | NG | good | good | good | fair | good |
| Scuff resistance | | Rating | good | good | good | good | NG | good | good | good | good | good | good |
| Durability to repeated impact | | Rating | good | good | good | good | good | good | good | good | NG | good | NG |

As is apparent from the results in Table 4, the golf balls in Comparative Examples 1 to 8 were inferior in the following way to the golf balls of the invention that were obtained in the Working Examples.

In Comparative Example 1, the cover material was made of an ionomer, and thus had a poor scuff resistance.

In Comparative Example 2, the core deflection was small (meaning that the ball was hard), and so the feel at impact was poor.

In Comparative Example 3, because the cover hardness was too low and the value obtained by subtracting the intermediate layer material hardness from the cover material hardness is lower (more negative) than −10, the ball was too receptive to spin on shots with a driver (W#1), as a result of which a good distance was not obtained.

In Comparative Example 4, injection molding targeted at a cover thickness of 0.4 mm was attempted, but the resin material did not spread properly within the mold cavity, as a result of which complete molding of the ball was not possible.

In Comparative Example 5, the cover thickness was too large and the sum of the intermediate layer thickness and the cover thickness exceeded 2.3 mm, as a result of which the ball was too receptive to spin on driver (W#1) shots and a good distance was not obtained.

In Comparative Example 6, the intermediate layer was too thin, as a result of which the spin rate on shots with a driver (W#1) increased and a good distance was not obtained. In addition, the durability to repeated impact was poor.

In Comparative Example 7, the intermediate layer was too thick, in addition to which the sum of the intermediate layer thickness and the cover thickness exceeded 2.3 mm, and so the feel at impact was poor.

In Comparative Example 8, the intermediate layer material had a melt flow rate of less than 2.5 g/10 min and the durability to cracking on repeated impact was poor.

Japanese Patent Application No. 2016-231550 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core of at least one layer, a cover of at least one layer, and at least one intermediate layer interposed between the core and the cover, wherein the core has a deflection when compressed under a final load of 1,275 N (130 kgf) from an initial load state of 98 N (10 kgf) of at least 4.0 mm, the intermediate layer material has a melt flow rate (MFR) of at least 2.5 g/10 min, the intermediate layer has a thickness of from 1.0 to 1.8 mm, the cover is composed primarily of polyurethane, the cover has a thickness of from 0.5 to 1.0 mm, the cover has a Shore D hardness of at least 55, the sum of the intermediate layer thickness and the cover thickness is not more than 2.2 mm, and the value obtained by subtracting the Shore D hardness of the intermediate layer material from the Shore D hardness of the cover material is from −10 to 0, and wherein the core is formed of a rubber composition comprising:

(a) a base rubber, (b) an α,β-unsaturated carboxylic acid and/or a metal salt thereof, (c) a crosslinking initiator, and (d) a metal carboxylate in which the carboxylic acid bonded to metal is of two or more different types and at least one of the carboxylic acids has 8 or more carbon atoms, the component (d) being selected from the group consisting of zinc monostearate monopalmitate, zinc monostearate monomyristate, zinc monostearate monolaurate, zinc monopalmitate monomyristate, zinc monopalmitate monolaurate, zinc monostearate monoacrylate, zinc monostearate monomethacrylate, zinc monostearate monomaleate, zinc monostearate monofumarate, zinc monopalmitate monoacrylate, zinc monopalmitate monomethacrylate, zinc monopalmitate monomaleate, zinc monopalmitate monofumarate, zinc monomyristate monoacrylate, zinc monomyristate monomethacrylate, zinc monomyristate monomaleate, zinc monomyristate monofumarate, zinc monolaurate monoacrylate, zinc monolaurate monomethacrylate, zinc monolaurate monomaleate and zinc monolaurate monofumarate.

2. The golf ball of claim 1, wherein the intermediate layer material has a Shore D hardness of from 62 to 67.

3. The golf ball of claim 1, wherein the ball has a surface hardness, expressed in terms of Shore D hardness, of from 58 to 68.

4. The golf ball of claim 1, wherein the (cover thickness)/(intermediate layer thickness) value is from 0.3 to 1.0.

5. The golf ball of claim 1, wherein the core has a deflection when compressed under a final load of 1,275 N (130 kgf) from an initial load state of 98 N (10 kgf) of from 4.2 to 4.9 mm.

6. The golf ball of claim 1 wherein, letting CH be the deflection of the core when compressed under a final load of 1,275 N (130 kgf) from an initial load of 98 N (10 kgf) and BH be the deflection of the ball when compressed under a final load of 1,275 N (130 kgf) from an initial load of 98 N (10 kgf), the value CH−BH is from 1.1 to 1.8 mm.

7. The golf ball of claim 1, wherein the value obtained by subtracting the cover thickness from the intermediate layer thickness is from 0.3 to 1.0 mm.

8. The golf ball of claim 1, wherein the upper limit of the melt flow rate (MFR) of the intermediate layer material is 4.0 g/10 min.

9. The golf ball of claim 1, wherein an ionomer resin is used as the intermediate layer material and the content of unsaturated carboxylic acid (acid content) included in the intermediate layer material is at least 10 wt %.

* * * * *